United States Patent [19]

Sado et al.

[11] Patent Number: 5,005,278

[45] Date of Patent: Apr. 9, 1991

[54] METHOD OF CONTROLLING THE OPERATION OF APPLYING A SUCCESSION OF DISCRETE COUPLING ELEMENTS

[75] Inventors: Chiharu Sado, Kurobe; Yasuhiko Matsuda, Toyama, both of Japan

[73] Assignee: Yoshida Kogyo K.K., Tokyo, Japan

[21] Appl. No.: 502,403

[22] Filed: Mar. 30, 1990

[30] Foreign Application Priority Data

Mar. 31, 1989 [JP] Japan ..... 1-82207

[51] Int. Cl.[5] ..... B21D 53/50

[52] U.S. Cl. ..... 29/408; 29/709; 29/714; 29/809

[58] Field of Search ..... 29/408, 769, 709, 714, 29/809, 410; 364/468

[56] References Cited

U.S. PATENT DOCUMENTS 4,625,375 12/1986 Osaki ..... 29/408

*Primary Examiner*—P. W. Echols

*Attorney, Agent, or Firm*—Hill, Van Santen, Steadman & Simpson

[57] ABSTRACT

A method of controlling the operation of applying discrete coupling elements one at a time onto a stringer tape, which comprises counting the number $N_1$ of coupling elements entering a chute and comparing the number $N_1$ thus counted with the number R of reovlutions of a motor driving a means of applying the elements to the tape thereby incessantly monitoring the inventory Nc of the elements in the chute.

2 Claims, 3 Drawing Sheets

METHOD OF CONTROLLING THE OPERATION OF APPLYING A SUCCESSION OF DISCRETE COUPLING ELEMENTS

BACKGROUND OF THE INVENTION

1. Field of the Invention

This invention relates to a method of controlling the operation of applying a succession of discrete coupling elements one at a time onto a stringer tape in the manufacture of slide fasteners.

2. Prior Art

Various methods and means have been devised for controlling the operation of applying an array of discretely formed coupling elements one at a time onto a stringer tape which is intermittently moved. One such typical method relies on the use of a number of usually about three to four photoelectric detectors provided along the length of a feed chute, wherein an uppermost detector is preset to determine a normal operating speed; a plurality of intermediate detectors are set to reduce the operating speed stepwise or progressively; and a lowermost detector is preset to discontinue the application of coupling elements to the stringer tape. This prior art method has a drawback in that when the operating speed of applying coupling elements to the tape is changed from high to low or vice versa, the apparatus including means of moving the stringer tape and means of applying the coupling elements to the tape would lag behind due to inertia in responding to such speed variations, resulting in irregularities in the interspacing between adjacent coupling elements mounted on the tape. Another drawback is that the inventory or amount of coupling elements present in the feed chute is made known only at the areas at which the detectors are installed, but not elsewhere in the chute so that there would inevitably develop certain time loss in the production of slide fasteners as a whole.

SUMMARY OF THE INVENTION

It is a primary object of the present invention to provide a method of controlling the operation of applying a succession of discrete coupling elements at substantially constant or equal intervals along a longitudinal edge of a stringer tape by continuously or incessantly monitoring the inventory of coupling elements within a feed chute through which the elements are fed and transferred onto the tape.

This and other objects and features of the invention will appear apparent from the following description taken in conjunction with the accompanying drawings.

According to the invention, there is provided a method of controlling the operation of applying a succession of discrete coupling elements, supplied through a chute, onto a stringer tape at constant intervals along a longitudinal edge thereof, which method comprises the steps of detecting and counting the number $N_1$ of the coupling elements which have entered the chute at one end thereof; subtracting from the number $N_1$ the number $N_2$ of the coupling elements which have been applied onto the tape thereby monitoring the inventory or number Nc of the coupling elements within the chute; and adjusting the speed of applying the coupling elements to an extent corresponding to the number Nc of the coupling elements being monitored.

DETAILED DESCRIPTION OF THE INVENTION

Figure 4:
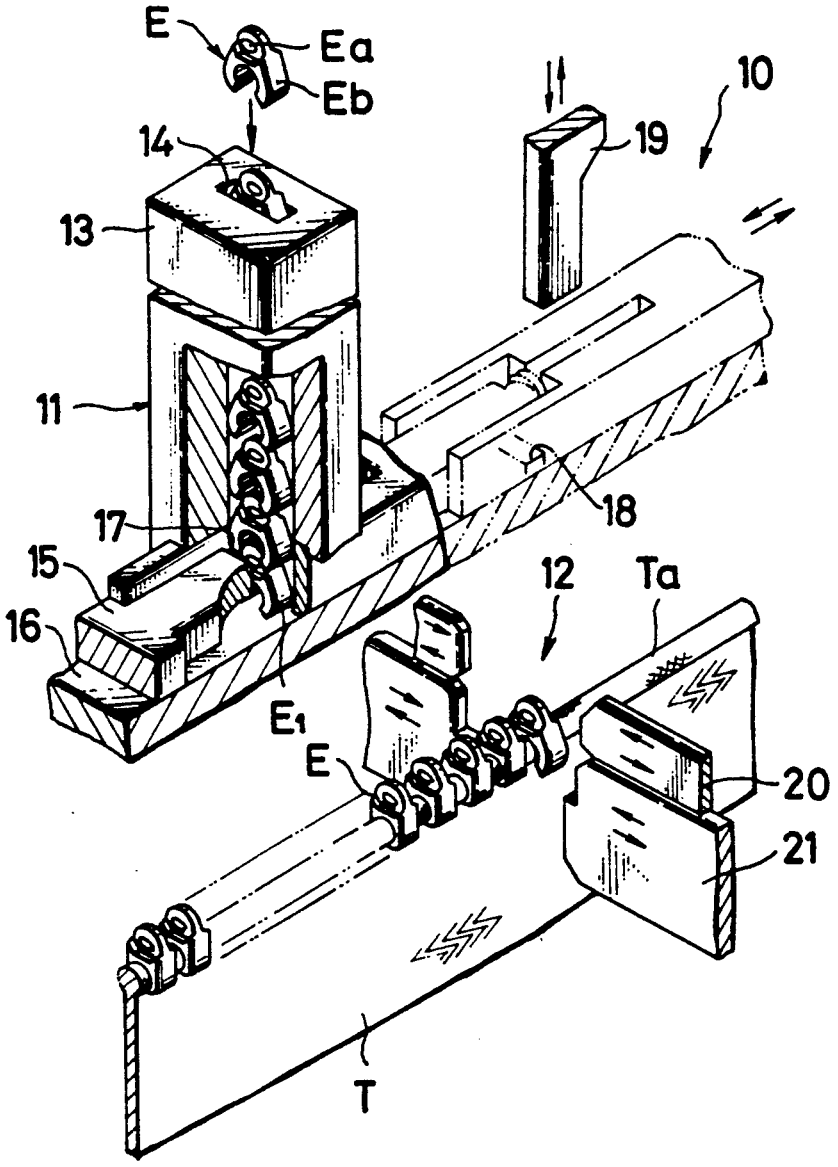
FIG. 4 is a perspective view of an apparatus for feeding and applying a succession of coupling elements one at a time onto a stringer tape.

Referring now to the drawings and firstly to FIG. 4, there is shown an apparatus 10 for feeding and applying discrete coupling elements successively one at a time to a longitudinal beaded edge Ta of a stringer tape T. Each coupling element E has a coupling head Ea and a pair of bifurcated legs Eb which are mounted astride of and clamped to the tape edge Ta in a manner to be hereinafter described. The apparatus 10 comprises an element feed unit 11 for supplying the coupling elements E and an element applying unit 12 for applying the coupling elements to the tape T. The feed unit 11 comprises a vertically disposed chute 13 having an elongate guide slot 14 through which the coupling elements E are allowed to move downwardly by gravity, and a horizontally disposed slide 15 supported on a base 16 for horizontal reciprocating movement effected by suitable drive means not shown.

Figure 5A:
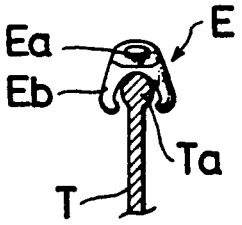
FIG. 5*a* is a diagrammatic elevational view of the coupling element shown mounted astride the tape edge.
Figure 5B:
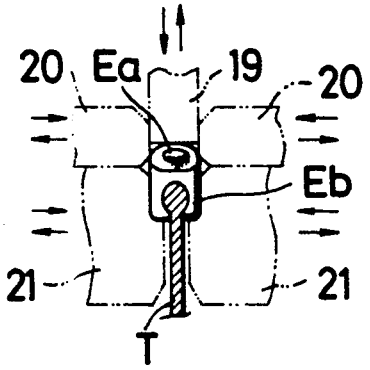
FIG. 5*b* is a diagrammatic elevational view of the coupling element shown clamped onto the tape edge.

A pocket 17 is formed in the slide 15 for receiving a leading or lowermost one $E_1$ of the coupling elements E from the chute 13. A transfer opening 18 is formed extending through the slide 15 and the base 16 and registrable with the pocket 17 for receiving the coupling element E which has been transferred on the slide 15. The element E is let fall by gravity through the transfer opening 18 onto the tape T which is oriented with its beaded edge Ta held upright and in parallel opposed relation to the base 16 and in registry with the transfer opening 18. As the element E is mounted with its bifurcated legs Eb astride the tape edge Ta as shown in FIG. 5*a*, it is held so in place by a vertical positioning member 19 vertically movable to hold the upper surface of the head Ea of the element E and a pair of horizontal positioning members 20 horizontally movable toward and away from each other and adapted to hold the element head Ea from both sides thereof as shown in FIG. 5*b*. With the element E thus held in position, it is firmly attached to the tape T by means of a pair of punches 21 which clamp or clinch the respective legs Eb of the element against the tape edge Ta in a manner illustrated in FIG. 5*b*. The punches 21 are driven by an electric motor M (FIG. 1) which is controlled in a manner later described so that one each revolution thereof per unit time provides one cycle of reciprocation of the punches 21 to complete the attachment of one coupling element E to the tape T.

Figure 1:
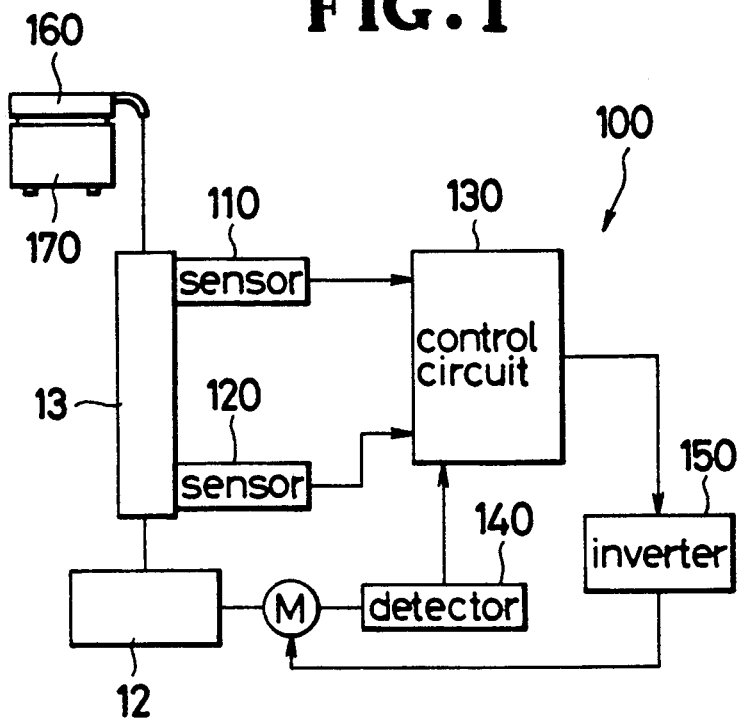
FIG. 1 is a schematic diagram utilized to illustrate a control device for carrying the inventive method into practice.

Referring now to FIG. 1, there is schematically illustrated a control device generally designated at 100 which is provided according to a preferred embodiment for carrying into practice the inventive method of controlling the operation of the element feeding and applying apparatus 10 so as to ensure attachment of the coupling elements E properly at equal intervals or at a constant element-to-element pitch on and along the longitudinal edge Ta of the stringer tape T. The control device 100 essentially comprises an upper-limit photoelectric sensor 110 located at the upper end of the feed chute 13 for detecting the number $N_1$ of coupling elements E entering the chute 13 and a lower-limit photoelectric sensor 120 located at the lower end of the chute 13 for detecting the number $N_2$ of coupling elements E entering the element applying unit 12.

A main control circuit means 130 receives a signal for example in the form of a pulse from each of the sensors 110 and 120 and includes a counter for counting the number $N_1$ of pulses transmitted from the upper-limit sensor 110 and a memory for storing the number of such pulses counted. The circuit means 130 further includes a controller programmed to maintain the number R of revolutions of the motor M substantially in proportion to the number Nc of coupling elements E within the chute 13.

A detector 140 detects the number R of revolutions of the motor M corresponding to the number Nc of elements E in the chute 13 and transmits a corresponding signal to the controller in the main control circuit means 130 which in turn transmits a control signal representing the number $N_1$ of elements E detected, i.e. the number R of revolutions made by the motor M, to a frequency inverter 150. This inverter controls the motor M by varying the frequency of a power therefor in accordance with the number Nc of elements E increased or decreased within the chute 13.

The arrangement of the control device 100 is such that the number Nc of coupling elements E or the inventory thereof within the chute 13 at any given point of time can be monitored by counting and comparing the number $N_1$ of elements E passing through the upper-limit sensor 110 with the number R of revolutions of the motor M. Ideally, the inventory Nc of coupling elements E in the chute 13 is constant between the upper-limit sensor 110 and the lower-limit sensor 120 so that the motor M remains at a constant preset rate of speed. If however for some reason the inventory Nc of elements E in the chute 13 is reduced, this is readily detected by the detector 140 to reduce the speed of the motor M accordingly. Such instance would often occur when the supply of coupling elements E to the chute 13 is discontinued due to operational failure of a vibratory bowl 160 on a parts feeder 170 or due to the absence of elements E in the bowl 160, leading to discontinued function of the upper-limit sensor 110.

Figure 2:
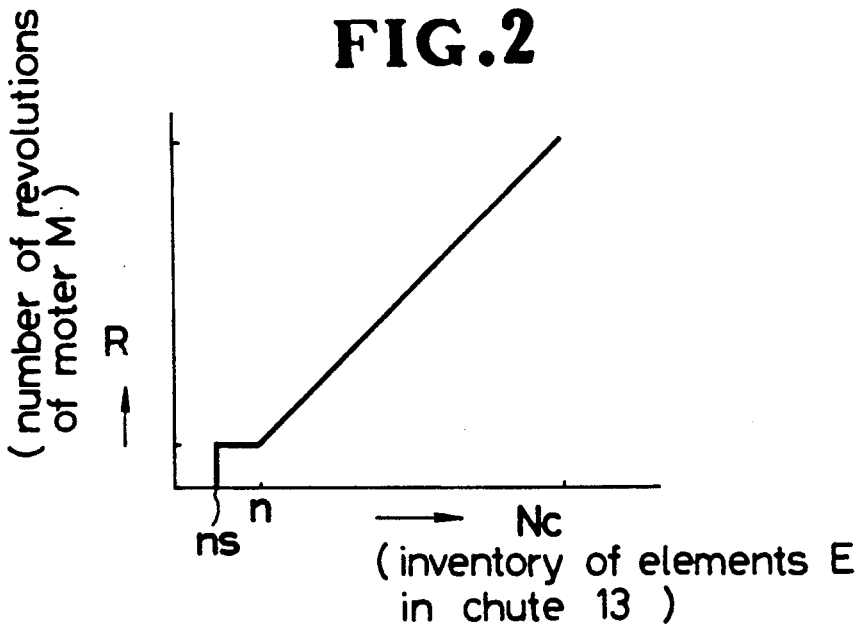
FIG. 2 is a graph showing the rate of speed of a motor plotted against the number of coupling elements present in a feed chute.

FIG. 2 graphically plots the number R of revolutions or speed of the motor M against the number Nc of coupling elements E within the chute 13, from which it is evident that both numbers R and Nc remain in direct proportion provided a substantial level of inventory of elements E is established in the chute 13. However, if the inventory or number N of elements is reduced for one reason or another drastically to a level Nn, the motor M is preset to continue operation at a predetermined minimum rate of speed required to maintain the punches 21 in proper clamping operation, and as the inventory Nc of elements E becomes finally nil in the chute 13 as indicated at Ns in FIG. 2, this is detected by the lower-limit sensor 120 to transmit a corresponding signal to the main control circuit means 130 so as to discontinue the operation of the motor M. When the supply of coupling elements E from the parts feeder 170 is resumed, the number N of elements E gradually increases in the chute 13 with corresponding increase in the speed or number R of revolutions per unit time of the motor M until the inventory Nc of elements E is built up in the chute 13 such that the speed R of the motor M becomes proportionate to the number N of elements E.

Figure 3:
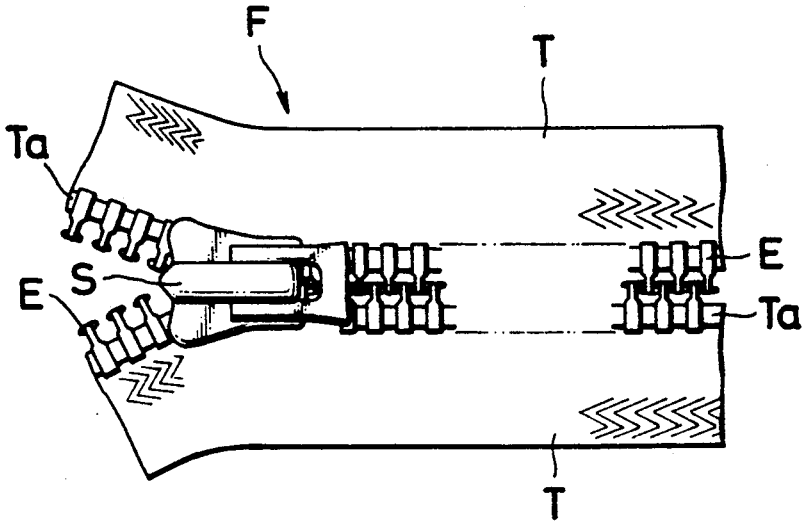
FIG. 3 is a fragmentary plan view of a slide fastener.

FIG. 3 shows a slide fastener F carrying rows of discrete coupling elements E on respective longitudinal edges Ta of a pair of stringer tapes Ta, the coupling elements E being aligned in properly or equally pitched relation maintained by the practice of the invention such that they can be coupled and uncoupled smoothly by a slider S in a manner well known in the art.

Advantageously, the method of the invention provides incessant monitoring of the inventory of coupling elements in the chute 13 to enable a continuous or uninterrupted operation of applying the elements E one at a time at controlled rate of speed onto the stringer tape T regardless of changes in the number Nc of elements E in the chute 13 and thus to ensure the attachment of elements E at constant, equal intervals along the tape edge Ta.

Obviously, various modifications and variations of the present invention are possible in the light of the above teaching. It is therefore to be understood that within the scope of the appended claims the invention may be practiced otherwise than as specifically described.

What is claimed is:

1. A method of controlling the operation of applying a succession of discrete coupling elements, supplied through a chute, onto a stringer tape at constant intervals along a longitudinal edge thereof, which method comprises the steps of:

(a) detecting and counting the number $N_1$ of said coupling elements which have entered said chute at one end thereof;

(b) subtracting from said number $N_1$ the number $N_2$ of said coupling elements which have been applied onto said tape thereby monitoring the inventory or number Nc of said coupling elements within said chute; and (c) adjusting the speed of applying said coupling elements to an extent corresponding to said number Nc of said coupling elements being monitored.

2. A method according to claim 1 further comprising maintaining the rate of speed of applying said coupling elements in direct proportion with the inventory Nc of said coupling elements in said chute.

* * * * *